US005984158A

United States Patent [19]

Frank

[11] Patent Number: 5,984,158

[45] **Date of Patent: *Nov. 16, 1999**

[54] CUTTING BLADE FOR CUTTING SHEET MATERIALS

[75] Inventor: Armin C. Frank, Wyndmoor, Pa.

[73] Assignee: Metal Edge International, Inc., North Wales, Pa.

[ * ] Notice: This patent is subject to a terminal disclaimer.

[21] Appl. No.: 08/987,626

[22] Filed: Dec. 9, 1997

Related U.S. Application Data

[63] Continuation-in-part of application No. 08/826,894, Apr. 9, 1997, which is a continuation-in-part of application No. PCT/US96/18923, Nov. 27, 1996

[60] Provisional application No. 60/032,695, Dec. 11, 1996.

[51] Int. Cl.[6] ..... B26F 3/02

[52] U.S. Cl. ..... 225/91; 225/48

[58] Field of Search ..... 225/91, 41, 42, 225/43, 46, 47, 48, 49, 56, 77, 92; 83/660, 649

[56] References Cited

U.S. PATENT DOCUMENTS

| | | | |
|---|---|---|---|
| 1,939,812 | 12/1933 | Hamersely | 206/58 |
| 2,316,469 | 4/1943 | Thor | 206/58 |
| 2,766,877 | 10/1956 | Burbank | 206/58 |
| 2,771,186 | 11/1956 | Burbank | 206/58 |
| 2,820,281 | 1/1958 | Amsen | 29/78 |
| 3,147,658 | 9/1964 | Boyd | 83/660 X |
| 3,450,318 | 6/1969 | Turner | 225/65 |
| 3,567,087 | 3/1971 | Schramm | 255/43 |
| 3,970,230 | 7/1976 | Horn | 225/65 |
| 4,005,809 | 2/1977 | Finn | 225/49 |
| 4,196,647 | 4/1980 | Fish | 83/649 X |
| 4,340,162 | 7/1982 | Heiman et al. | 225/48 |
| 4,346,829 | 8/1982 | Myers | 225/48 |
| 4,346,830 | 8/1982 | Hauser | 225/49 |
| 4,669,191 | 6/1987 | Schramm | 83/660 X |
| 4,972,747 | 11/1990 | Boyd et al. | 83/678 |
| 4,972,984 | 11/1990 | Frank et al. | 225/20 |
| 4,998,656 | 3/1991 | Hurh | 225/47 |
| 5,067,222 | 11/1991 | Frank et al. | 29/411 |
| 5,363,997 | 11/1994 | Harris | 225/47 X |
| 5,634,580 | 6/1997 | Levy | 225/56 |

FOREIGN PATENT DOCUMENTS

| | | | |
|---|---|---|---|
| 5-51029 | 3/1993 | Japan . | |
| 2095154 | 9/1982 | United Kingdom | 225/91 |

*Primary Examiner*—Rinaldi I. Rada
*Assistant Examiner*—T. Anthony Vaughn
*Attorney, Agent, or Firm*—Dann, Dorfman, Herrell & Skillman, p.C.; Henry H. Skillman; Stephen H. Eland

[57] ABSTRACT

A cutting assembly for aluminum foil dispensers. The cutting assembly comprises a member corresponding to the length of the dispenser carton. The member has a U-shaped cross-section adapted to slip over the free edge of the front panel of the dispenser carton having a base web with one leg on the inside of the carton and a second leg exposed on the outside of the carton. The inside leg has an extension which is bent back over the leg and extends the full height of the inside leg to project above the base web of the U-shaped member. The upward extension is serrated with a continuous row of teeth projecting above the base, preferably a depth of 0.020". The outside leg of the member has a flap which is bent back internally of the U-shaped member to provide a retainer strip which projects angularly upward and inward of the U-shaped member to provide a resilient flap which resists upward displacement of the member from the panel. The base web of the panel is flat, extending perpendicularly to the legs with a width of at least seven times the depth of the teeth. The height of the legs is about 1-½ times the width of the web.

10 Claims, 2 Drawing Sheets

CUTTING BLADE FOR CUTTING SHEET MATERIALS

RELATED APPLICATION

This application is a continuation-in-part of U.S. application Ser. No. 08/826,894 filed Apr. 9, 1997, still pending, which is a continuation-in-part of International Patent Application No. PCT/US96/18923 filed Nov. 27, 1996, and claims priority to U.S. Provisional Application Nos. 60/007,854 filed Dec. 1, 1995 and 60/008,587 filed Dec. 13, 1995. This application also claims priority to U.S. Provisional Application No. 60/032,695 filed Dec. 11, 1996.

FIELD OF THE INVENTION

The present invention relates to cutting blades for cutting sheet materials. More specifically, the present invention relates to cutting blades used to sever aluminum foil that is dispensed from a roll.

BACKGROUND OF THE INVENTION

Metal foil is widely used throughout the food industry to wrap or cover various food products. The foil is typically dispensed from a roll contained in a box. Whenever a piece of foil is required, the length of the foil is withdrawn from the box and cut to length by a cutting blade that is attached to the front panel of the carton. The cutting blade commonly used for many years has been a thin metallic saw-toothed blade having cutting points extending along the exposed edge of the blade. Although the points of the cutting blade can nick or cut the user, the real risk to the user is due to the fact that the cutting blade is made of a thin strip of metal. Just as a piece of paper can cause a cut, a thin strip of metal, with or without saw-toothed points, can cut.

SUMMARY OF THE INVENTION

In accordance with the present invention, a cutting blade for cutting foil is provided which reduces the risk of inadvertent cuts to the users. The cutting blade allows a user to withdraw a length of sheet material, such as metal foil from a dispenser, and cut the foil to length without serious risk of injury to the user. The cutting blade has two parallel longitudinally elongated edges connected by a web in the form of a substantially flat surface. Two longitudinally-elongated fold lines extend along the edges, and a row of teeth project from the flat surface alongside one of the edges, so that the row of teeth is parallel to the fold lines and projects separately from the fold lines.

The teeth extend continuously along the entire length of the blade so as to insure a continuous cutting action which avoids intermittent tearing which may occur if there are interruptions in the row of teeth. The teeth are limited in height and are positioned with their roots substantially in the extended plane of the flat surface, and their tips projecting above the extended plane by a small fraction of the width of the web between its elongated edges. The limited projection of the teeth above the plane of the web reduces the ability of the tips to inadvertently cut the user.

BRIEF DESCRIPTION OF THE DRAWINGS

All of the objectives of the present invention are more fully set forth hereinafter with reference to the accompanying drawings, wherein.

DETAILED DESCRIPTION OF THE PREFERRED EMBODIMENT

Figure 1:
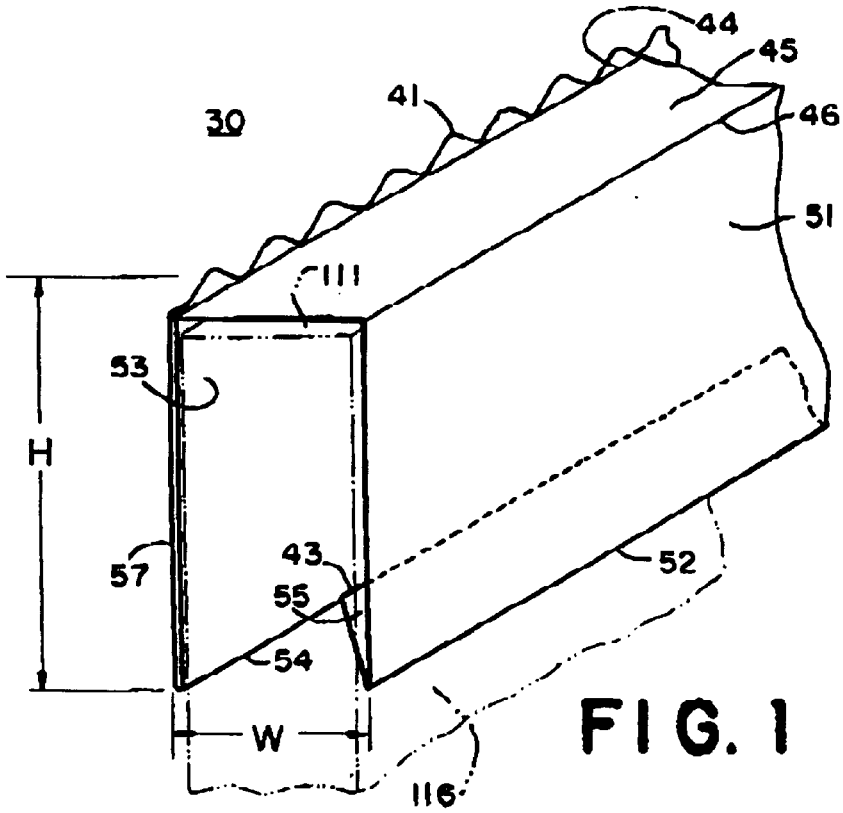
FIG. 1 is a fragmentary perspective view of a cutting blade incorporating the present invention.
Figure 3:
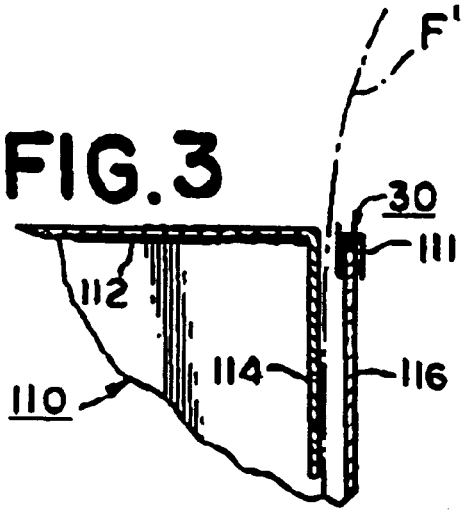
FIG. 3 is a fragmentary cross-sectional view of the front of a carton carrier showing the cutting blade of FIG. 1 slipped in place.

Referring now to the drawings in general and FIG. 1 specifically, there is shown a cutting blade 30 used for cutting sheet materials such as metal foil. In FIG. 5, the cutting blade 30 is shown in connection with a dispensing carton 110. A roll of metal foil (not shown) is contained within the carton 110. The cutting blade 30 is shown engaged on the free edge 111 of the front panel 116 of the carton 110. The carton has a lid 112 with a flap 114 which is designed to slip behind the panel 116. In operation, the user normally opens the lid and draws a length of the foil from the bottom of the roll in the dispenser carton 110, as shown at F' in FIG. 3, and cuts the material to length by pulling the material angularly outward over the cutting blade 30. To ensure that the entire width of the foil is cut rather than torn, it is desirable for the cutting blade 30 to be at least as wide as the roll of foil in the dispenser carton, and that the cutting teeth extend continuously throughout the length of the blade 30.

The cutting blade 30 may be made from a continuous thin metal band. The band is bent or rolled into an U-shaped cross-section as shown in FIG. 1.

Figure 2:
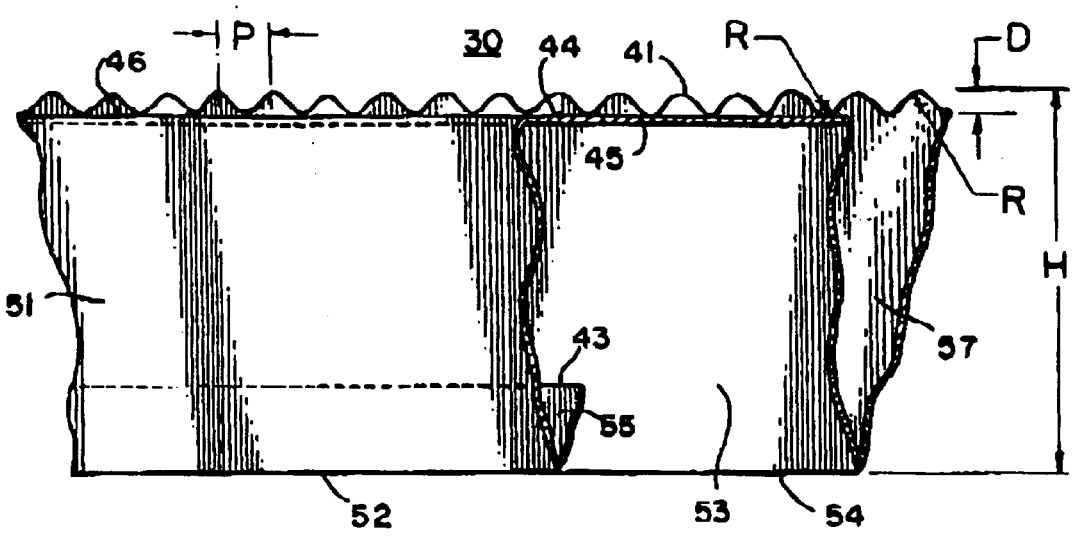
FIG. 2 is a front view of the cutting blade shown in FIG. 1 with portions broken away sequentially.
Figure 4:
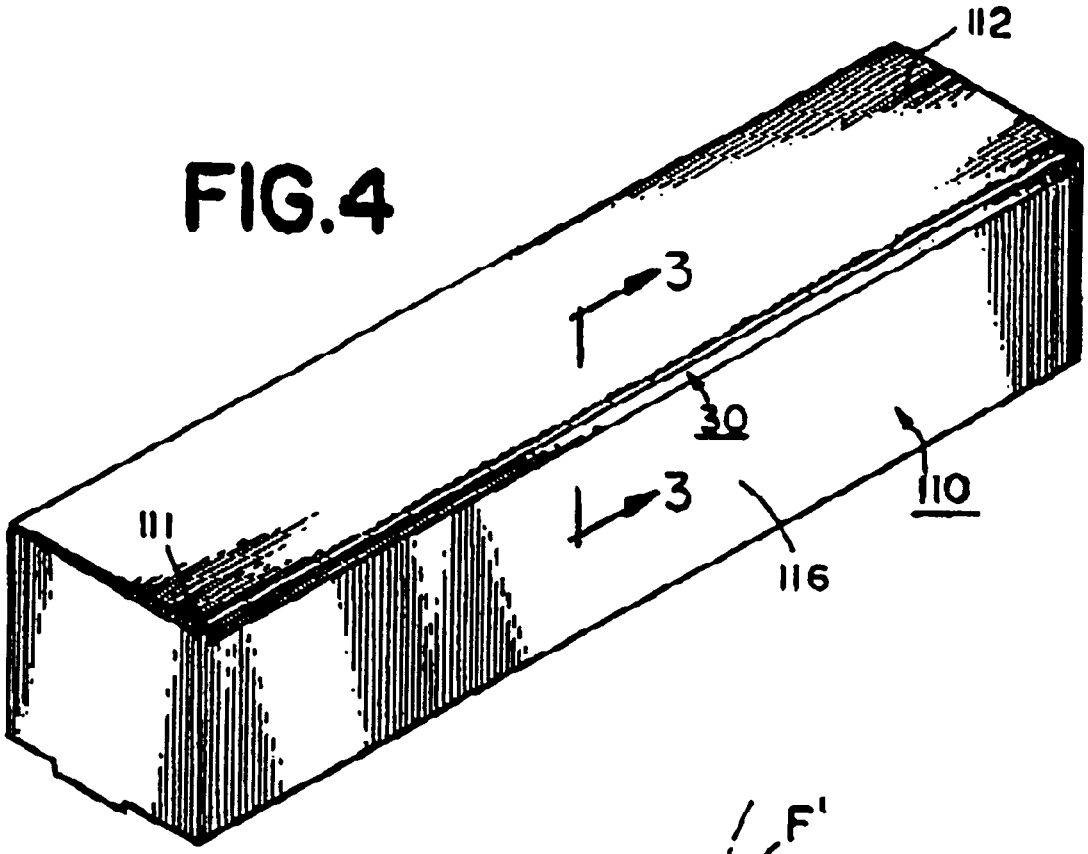
FIG. 4 is a perspective view of a dispenser carton having the cutting blade of FIG. 1 in place.

The forming of the cutter blade 30 produces a continuous row of teeth 41 along one longitudinal edge of the band and a continuous gripper edge 43 along the opposite longitudinal edge of the band. The formation of the teeth 41 produces burrs on one surface of the band along the toothed edge. The band is then bent into a U-shape as shown in FIGS. 1 and 2, producing a central web 45 at the base of the U and legs 51 and 53 depending downwardly in the same direction from the web 45 to form the legs of the U. At the free extremity of the leg 51, an end flap 55 is reversely bent inwardly into the interior of the U-shaped formation, the flap 55 terminating in the gripper edge 43. The opposite leg 53 of the U has an extension 57 which is reversely bent to overlie the exposed outer surface of the leg 53 and extends parallel to the leg 53 upwardly beyond the web 45. The teeth 41 are at the free edge of the reversely bent extension 57 and project above the extended plane of the web 55.

As shown in FIG. 1, the surface of the band which exhibits burrs on the extension 57 is the surface of the band facing toward the left in FIG. 1. The burrs on the teeth 41 assist in providing a cutting action for the foil as it is drawn over the cutting edge. The flap 55 provides a good grip on the panel 16 when the cutter bar is slipped over the free edge of the panel.

As shown in FIG. 1, the web 45 is flat and extends between fold lines 44 and 46 which define the longitudinal edges of the web. The leg 51 extends from the fold line 46 to a reverse bend 52 which enables the flap 55 to form an acute angle with the leg 51. The bends 44, 46 and 52 are made in the same direction. The leg 53 is reversely bent in the opposite direction along the reverse bend line 54. The reverse bend line 54 is bent so that the surface of the band which exhibits the burrs is directed outwardly from the U-shaped cross-section.

Referring now to FIGS. 1 and 2, the cutting blade 30 comprises a continuous row of cutting teeth 41. Because the cutting teeth 41 project above a flat surface, the cutting teeth will only cut as deep as the height that the cutting teeth project above the web surface 45. Therefore, to limit the depth of a potential cut to a user, the teeth 41 are preferably 0.015"–0.035" in depth D. In the present instance, the cutting teeth 41 project approximately 0.020" from the flat surface 45. In addition, the teeth 41 are closely spaced from one another to reduce the possibility of cutting a user. In the present instance, the pitch P of the teeth is between 3.5 and 4.0 times the depth D of the teeth, e.g. 3.65. The teeth are generally triangular having roots which are substantially coplanar with the surface of the web 45 and points which project less than 0.035" from the surface.

If the cutting teeth are spaced sufficiently close to one another, the weight supported by any one tooth is insufficient to puncture the skin of the user. The result is similar to a bed of nails employed by fakirs. In the same way that the bed of nails are closely spaced so that the fakir can lie upon the bed of nails without puncturing his skin, if the teeth in the cutting blade are closely spaced, the risk of puncturing human skin is reduced. However, the cutting teeth must still be able to cut the metal foil. Therefore, a satisfactory design will act like a fakir's bed of nails when in contact with the skin of the user, and also act like a cutting blade when the foil is pulled angularly outward over the cutting blade. This may be accomplished because foil is typically more frangible and bendable than human skin, thus being easily pulled down over the points of the cutting teeth and thereby cut. In addition, foil is typically much less compressible than human skin and thus easily tears when pulled down over the cutting teeth.

To produce the bed of nails effect so that the cutting blade cuts the foil, and not human skin, the teeth 41 are preferably in the range of 3.5 to 4.0 times the depth D of the teeth so that there are approximately 12–22 teeth per inch. In the present instance, there are approximately 13 teeth per inch in the row of teeth. In addition, as shown in FIG. 2, the teeth project substantially perpendicular to the flat surface of the web 45. The bases of the triangular teeth are aligned generally parallel to the fold lines 44 and 46, so that the teeth define an upstanding cutting edge which is also parallel to the fold lines.

To further reduce the risk of injury to the user, the points of the teeth 41 are rounded as shown in FIG. 2. In the illustrated embodiment, both the points and the roots of the triangular teeth are rounded with a radius Rwhich is three-quarters of the depth D of the teeth. With teeth having a depth of 0.020 inch, the points are formed with a radius of 0.015 inch.

The projection of the teeth 41 above the web surface 45 does not cause injury to the user. The width W of the flat surface of the web 45 is between 7 and 15 times the depth D of the teeth so as to effectively guard the teeth from injuring the user.

The cutter bar of the present invention is designed to be attached to the carton either by the end users or by the manufacturer of the packaged foil product. Configured as shown in FIG. 1, the user can slip the cutting blade 30 over a front panel 116 which is typically a piece of corrugated board having a free edge 111. Typically, the user will simply slip the cutting blade 30 over the front panel of a dispenser carton 110 until the underside of the web 45 seats against the free edge 111. The height H of the U-shaped blade 30 is approximately 1.5 times the width W, so as to enable the U-shaped blade to be firmly engaged over the free edge 111 of the panel 116. The rearwardly bent flap 55 of the cutting blade 30 tends to grip the cardboard 116 so that the cutting blade 30 resists being removed from the cardboard. In addition, by bending back the lower edges of both legs 51 and 53, the exposed edges of the legs are formed by reverse bends, thus eliminating the risk that the lower edges of the legs can inadvertently cut the user.

While particular embodiments of the invention have been herein illustrated and described, it is not intended to limit the invention to such disclosures, but changes and modifications may be made therein and thereto within the scope of the following claims.

I claim:

1. A cutting blade for cutting sheet materials, constructed and arranged to be grippingly engaged on a panel of a given thickness comprising:

a substantially flat web surface having two spaced-apart parallel longitudinally-elongated fold lines;

two longitudinally-elongated side legs connected to said web surface along said fold lines and extending generally perpendicular to said flat web surface below said flat web surface to provide an inverted U-shape having a space between said side legs greater than said thickness; and a continuous row of teeth separate from said flat web surface, spaced from and parallel to said fold lines, projecting above said flat web surface along one of said fold lines in a direction opposite to said legs and generally parallel thereto.

2. The cutting blade of claim 1 wherein said side legs have an upper edge connected to said web surface and a lower edge spaced from said web surface comprising a flap connected to the lower edge of one of said side legs by a reverse bend, said flap being bent inwardly of said U-shape and terminating in a gripper edge directed toward said web surface within said space of the U-shape, said gripper edge adapted to grippingly engage a panel positioned within said space.

3. The cutting blade of claim 1 wherein said side legs have an upper edge connected to said web surface and a lower edge spaced from said web surface comprising an extension connected to the lower edge of one of said side legs by a reverse bend, said extension lying flush against said leg outside of said U-shape space and terminating in an exposed edge forming said teeth perpendicular to said flat web surface.

4. A cutting blade according to claim 1 wherein said teeth have a given depth and a pitch between 3.5 and 4.0 times said given depth, said flat web surface having a width between its edges of between 7 and 15 times said given depth.

5. A cutting blade according to claim 4 wherein said teeth are generally triangular with points projecting upwardly and roots disposed in the extended plane of said flat web surface, said points and said roots having an arcuate outline having a radius less than said given depth.

6. A cutting blade for cutting sheet materials, constructed and arranged to be grippingly engaged on a panel of a given thickness comprising:

a web having two spaced-apart parallel longitudinally-elongated fold lines, a substantially flat surface connecting said fold lines, said two longitudinal fold lines extending along said web, and two longitudinally-elongated side legs connected to said flat surface at said fold lines and extending perpendicularly downwardly from said flat surface to form a downwardly-open channel below said flat surface, said channel providing a space between said side legs greater than said given thickness, said legs terminating in lower edges having reversely-bent extensions connected to the lower edges of said side legs, one of said extensions projecting angularly upward from its associated lower edge and having a free edge constituting a gripper edge within said downwardly-open channel, adapted to engage a panel positioned within said space, the other of said extensions protecting upwardly along its associated leg and terminating in a continuous row of longitudinally aligned teeth separate from said flat web surface and disposed along one of said fold lines, each of said teeth being a single substantially triangular cutting component projecting perpendicularly above said flat surface.

7. A cutting blade for cutting sheet materials, comprising:

a longitudinally-elongated band having a flat planar web surface with two spaced-apart parallel longitudinally elongated edges; and a single continuous row of teeth integrally formed from said band, each of said teeth having a base co-planar with said web surface and a projecting portion adjacent said web surface and extending generally perpendicularly upward from said web surface along one of said edges, wherein the projecting portion of each of said teeth projects approximately 0.015"–0.035" from said web surface, and said teeth are longitudinally aligned and spaced so tat there are approximately 12–22 teeth per inch.

8. The cutting blade of claim 7 comprising two longitudinally-elongated side legs having an upper edge connected to said edges, wherein said side legs are perpendicular to said flat web surface and terminate in lower edges which are spaced apart to provide a space between said side legs.

9. The cutting blade of claim 7 comprising one extension flange connected to the lower edge of one of said side legs, said one extension flange being reversely bent to extend into the space between said aside legs.

10. The cutting blade of claim 9 comprising a second extension flange connected to the other of said side legs, said second extension flange being reversely bent to extend along said other of said side legs outside of the space between said side legs.

* * * * *